US010655350B2

(12) United States Patent
Hartmann et al.

(10) Patent No.: US 10,655,350 B2
(45) Date of Patent: May 19, 2020

(54) CODE COMPLIANT RESIDENTIAL STRUCTURE FOR ASSEMBLY BY END USER

(71) Applicant: United States of America as Represented by The Secretary of The Army, Alexandria, VA (US)

(72) Inventors: Dale R Hartmann, Front Royal, VA (US); Tara C Brady, Kearneysville, WV (US); Michael D. Bluhm, Shawnee, KS (US)

(73) Assignee: UNITED STATES OF AMERICA AS REPRESENTED BY THE SECRETARY OF THE ARMY, Alexandria, VA (US)

( * ) Notice: Subject to any disclaimer, the term of this patent is extended or adjusted under 35 U.S.C. 154(b) by 0 days.

(21) Appl. No.: 15/815,652

(22) Filed: Nov. 16, 2017

(65) Prior Publication Data

US 2019/0145116 A1 May 16, 2019

(51) Int. Cl.

| | |
|---|---|
| ***E04H 1/12*** | (2006.01) |
| ***E04B 1/32*** | (2006.01) |
| ***E04B 1/348*** | (2006.01) |
| ***E04B 1/343*** | (2006.01) |
| *E04B 1/26* | (2006.01) |
| *E04B 2/84* | (2006.01) |
| *E04B 7/02* | (2006.01) |
| *E04H 3/08* | (2006.01) |

(52) U.S. Cl.

CPC ..... *E04H 1/1205* (2013.01); *E04B 1/3205* (2013.01); *E04B 1/3483* (2013.01); *E04B 1/34321* (2013.01); *E04B 1/34336* (2013.01); *E04B 2/84* (2013.01); *E04B 7/022* (2013.01); *E04B 2001/2644* (2013.01); *E04B 2001/3241* (2013.01); *E04B 2001/3252* (2013.01); *E04B 2001/34389* (2013.01); *E04H 3/08* (2013.01)

(58) Field of Classification Search

CPC ..... E04H 1/1205; E04H 3/08; E04B 1/34336; E04B 1/3205; E04B 1/3483; E04B 2001/34389; E04B 7/022; E04B 2/84; E04B 2001/3241; E04B 2001/2644; E04B 2001/3252

USPC ..... 52/79.1, 79.3, 79.5, 292, 690–697

See application file for complete search history.

(56) References Cited

U.S. PATENT DOCUMENTS 2,858,916 A * 11/1958 Josephs ..... E04B 1/24 52/377
2,990,588 A * 7/1961 McKinley ..... E04B 1/34315 52/143
3,220,079 A * 11/1965 Aggson ..... E04B 1/7076 52/302.3
4,091,582 A * 5/1978 Lawrence ..... E04B 1/34326 52/143

(Continued)

FOREIGN PATENT DOCUMENTS

JP 63051530 A * 3/1988

*Primary Examiner* — Brian E Glessner
*Assistant Examiner* — Adam G Barlow
(74) *Attorney, Agent, or Firm* — Brian C. Jones

(57) ABSTRACT

The disclosed invention is a housing apparatus comprised of foundation boxes, foundation box lids, in situ ballast material placed within the foundation boxes, floor panels, wall panels, binding strips, stackable trussed roof segments, roof gables, and load transferring batten strips.

20 Claims, 13 Drawing Sheets

(56) References Cited

U.S. PATENT DOCUMENTS

| | | | | |
|---|---|---|---|---|
| 4,501,098 | A * | 2/1985 | Gregory | E04H 1/02 52/143 |
| 8,904,737 | B2 * | 12/2014 | Schiffmann | E04B 2/56 52/270 |
| 9,366,030 | B2 * | 6/2016 | Spear | E04F 13/0894 |
| 9,422,713 | B2 * | 8/2016 | Trebil | E04B 1/0007 |
| 10,161,130 | B2 * | 12/2018 | Devlin | E04H 1/1205 |
| 2002/0174614 | A1 * | 11/2002 | Dilon | E02D 27/02 52/292 |
| 2004/0134162 | A1 * | 7/2004 | Douglas | E02D 27/02 52/741.1 |
| 2008/0016792 | A1 | 1/2008 | Messman | |
| 2008/0134609 | A1 * | 6/2008 | Vagedes | E06B 7/082 52/473 |
| 2009/0193725 | A1 * | 8/2009 | Harrisson | E04B 1/3442 52/66 |
| 2012/0005971 | A1 * | 1/2012 | Palmeri | E04B 2/7407 52/167.1 |
| 2015/0082721 | A1 * | 3/2015 | Francescon | F24F 13/12 52/302.1 |
| 2015/0218802 | A1 * | 8/2015 | Wolf | E04D 13/1637 52/404.3 |
| 2017/0145708 | A1 * | 5/2017 | Chen | E04B 1/34321 |
| 2018/0017281 | A1 * | 1/2018 | Ebersohl | F24F 13/082 |

* cited by examiner

CODE COMPLIANT RESIDENTIAL STRUCTURE FOR ASSEMBLY BY END USER

STATEMENT REGARDING FEDERALLY SPONSORED RESEARCH OR DEVELOPMENT

The invention described herein was made by an employee of the United States Government and may be manufactured and used by the Government of the United States of America for governmental purposes without the payment of any royalties thereon or therefore.

FIELD OF INVENTION

This invention relates to the field of buildings or light structures, and more specifically to rapidly assembled and disassembled housing structures.

BACKGROUND OF THE INVENTION

U.S. Army Corps of Engineers provides housing for military missions in remote international locations across the globe.

Existing military wood structures require skilled labor on site for construction, transportation of raw construction materials to the site of use, multiple days to complete each structure with skilled labor, and approximately 63 separate lumber and fastener components to construct. Existing military wood structures are not relocatable or transportable; and cannot be disassembled except by burning or destruction.

Structures known in the art are shipped by breaking down and packing components. It is a problem known in the art that breaking down a structure to decrease shipping size causes results in complex reassembly and disassembly, requiring tools and personnel that may not be readily available.

There is an unmet need for housing which can be easily assembled from light weight components in situ, and which can easily be shipped using standard shipping containers.

SUMMARY OF THE INVENTION

The disclosed invention is a housing apparatus comprised of foundation boxes, foundation box lids, in situ ballast material placed within the foundation boxes, floor panels, wall panels, binding strips, stackable trussed roof segments, roof gables, and load transferring batten strips.

TERMS OF ART

As used herein, the term "protective layer" means a coating or layer that protects material from outdoor exposure.

As used herein, the term "siding" means a layer of material.

DETAILED DESCRIPTION OF THE INVENTION

Figure 1A:
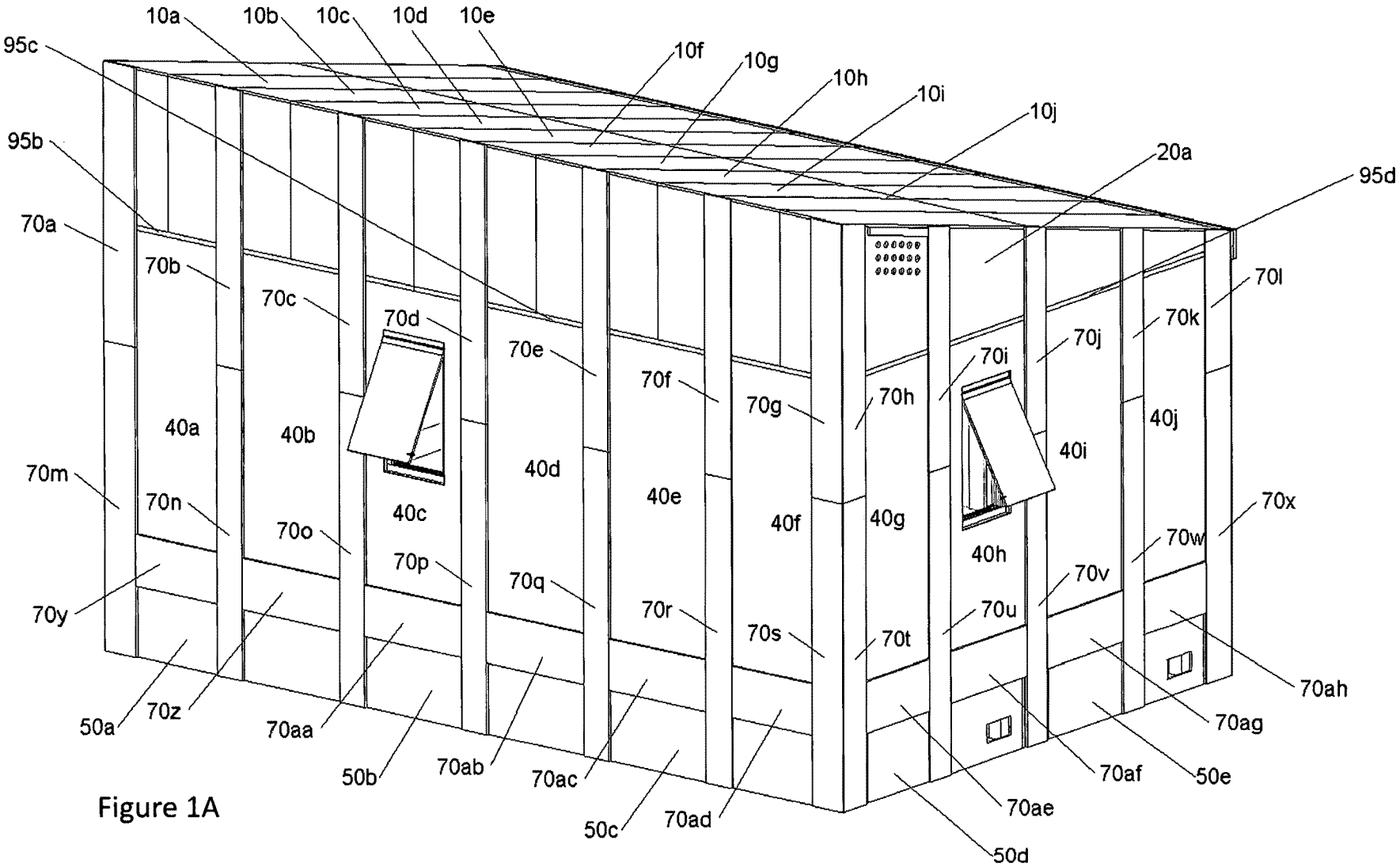
FIGS. 1A and 1B are perspective views of a CUBE structure.
Figure 1B:
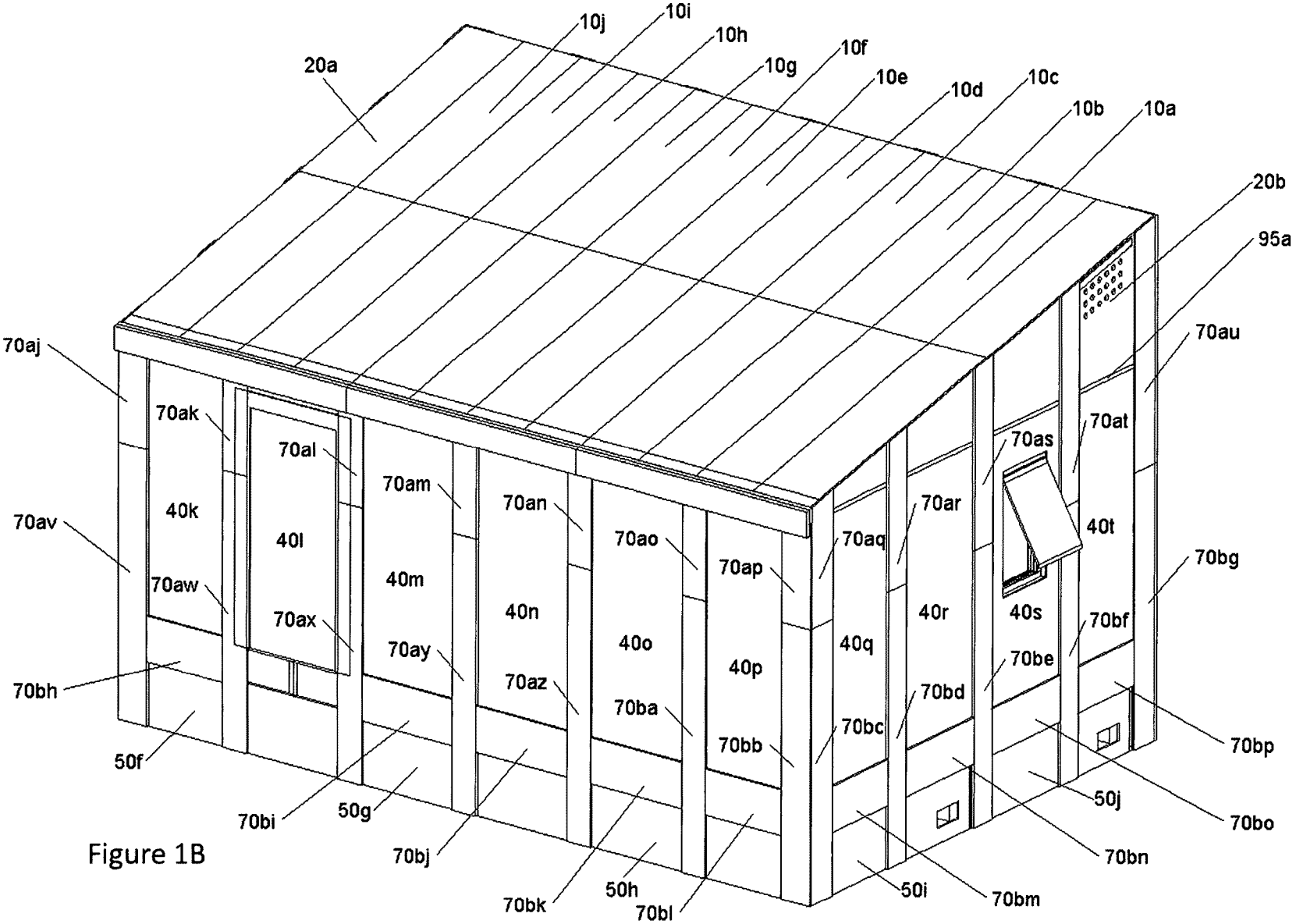

FIGS. 1*a* and 1*b* are perspective views of CUBE structure 100.

Common Uniform Building Envelope (CUBE) structure 100 is a low cost, low effort, relocatable facility. This facility meets the building code requirements of UFC 1-201-01 for use by US military personnel in support of a military operation.

Visible in FIGS. 1*a* and 1*b* are stackable trussed roof segments 10*a-j,* stackable trussed gabled roof segments 20*a-b,* wall panels 40*a-t,* foundation boxes 50*a-j,* batten strips 70*a-bp,* and binding strips 95*a-d.*

In the exemplary embodiment shown, stackable trussed roof segments 10*a-j* are attached to binding strips 95. Binding strips 95 are attached to the top of wall panels 40*a-t,* which rest on floor panels 30 (not visible because of batten strips 70*y-ah* and 70*bh-bp*), and floor panels 30 rest on foundation boxes 50*a-j.* Batten strips 70*a-bp* secure stackable trussed roof segments 10*a-j* to wall panels 40*a-t,* wall panels 40*a-t* to floor panels 30, and floor panels 30 to foundation boxes 50*a-j.* The gables on stackable trussed gabled roof segments 20*a-b* enclose the roof structure.

In various embodiments, wall panels 40 may be fabricated to include windows or doors. The presence of a door or window does not affect the installation procedure or load bearing capacity for any of wall panels 40. In various embodiments, the size of doors and windows is variable.

In the exemplary embodiment shown, door openings are 36 inches wide and 80 inches tall. The maximum allowable dimension for door width is 36 inches; maximum allowable door height is 87 and one half inches. Window openings are 44 inches tall and 24 inches wide. The maximum allowable dimension for window width is 36 inches; maximum allowable window height is 87 inches.

In various embodiments, stackable trussed roof segments 10 and foundation boxes 50 include vents to prevent the build-up of condensed water on otherwise enclosed surfaces.

Batten strips 70 cover all seams on the exterior of CUBE structure 100 and transfer force from stackable trussed roof segments 10 and wall panels 40 to floor panels 30 and foundation boxes 50. Batten strips 70*a-x* and 70*aj-bg* cover vertical lengths from the top of stackable trussed roof segments 10 to the bottom of foundation boxes 50. Batten strips 70*y-ah* and 70*bh-bp* cover the entire horizontal width of each wall of CUBE structure 100 at the seam where the foundation boxes meet the floor panels, and the floor panels meet the wall panels.

In the exemplary embodiment shown, components are not attached to each other except by batten strips 70 and there are no interior attachment components. This allows assembly, disassembly and reassembly of the building without skilled labor; this also makes it reusable. In various embodiments, batten strips 70 attach to other components via screws.

In various embodiments, the calculated width of batten strips 70 and the position and number of screws that attach batten strips 70 to the exterior of the building prevent CUBE structure 100 from collapsing under the stress of lateral forces such as a 115 mph 3 second gust, wind load, and vertical forces such as roof live load (20 pounds/square foot), earthquakes or a snow load (27 pounds/square foot, or approximately 10 inches of snow). In various embodiments, batten strips 70 are 10-12 inch wide strips cut from ½-thick pieces of plywood. The minimum batten strip width is 8 inches, without affecting the load transferring capability of batten strips 70.

In the exemplary embodiment shown, this facility can be shipped, assembled, disassembled, shipped, and reassembled at a different location all by unskilled labor. This facility can be expanded or contracted in size by unskilled labor. This facility removes the skilled and semiskilled labor, raw construction material and specialized tool requirements from the job site and shifts these requirements to a more easily stocked and protected fabrication site.

In various embodiments, the components of this facility can be fabricated under undeveloped field conditions by skilled or semiskilled labor.

In the exemplary embodiment shown, the exterior of CUBE structure 100 is 16 feet wide and 24 feet long. The highest point on the roof is 15 feet 2.5 inches above the ground and the lowest point on the roof is 11 feet 5 and ¾ inches above the ground. The minimum exterior width is 8 feet and the minimum exterior length is 8 feet. The width of 16 feet allows each stackable trussed roof segment 10 to weigh less than 200 pounds and eliminates a need for heavy machinery to lift each section. The width of 16 feet also optimizes both the size of CUBE structure 100 and the ability of wall panels 40 to supply support to stackable trussed roof segments 10.

In various embodiments, multiple CUBE structures 100 may be connected to increase the size of the structure. Each CUBE structure 100 would maintain all of its wall panels except for one panel that would be replaced by an open door frame to allow movement between the two connected structures. Any number of CUBE structures 100 may be connected. In the exemplary embodiment shown, the maximum exterior width is 32 feet; the maximum exterior lengths are 280 feet for the least restrictive occupancy category and 184 feet for the most restrictive occupancy category. If the total exterior dimensions of combined CUBE structures 100 are greater than 32 ft×280 ft (for the least restrictive occupancy category) or 32 ft×184 feet (for the most restrictive occupancy category), the structure would require a sprinkler system.

In various embodiments, the external appearance of CUBE structure 100 can vary without affecting its structural integrity.

In an alternate embodiment of the CUBE structure 100, the roof may be flat and perpendicular to the walls.

In various embodiments, CUBE structure 100 may be disassembled and re-assembled multiple times as needed, and matches the degree of re-usability of military tents. In the exemplary embodiment shown, CUBE structure 100 costs $26 per square foot to manufacture. Current options for structures that can be disassembled and reassembled multiple times (e.g. military tents) cost approximately $500 per square foot.

In various embodiments, CUBE structure 100 may be used for disaster recovery efforts through FEMA or other agencies or entities as well as refugee operations through the United Nations High Commissioner for Refugees. In various embodiments, CUBE structure 100 may be used for other humanitarian relief efforts for internally displaced person and refugees, housing for homeless persons, storage shed for homeowners, expandable housing for low income persons, or trailer mounted houses.

Figure 1C:
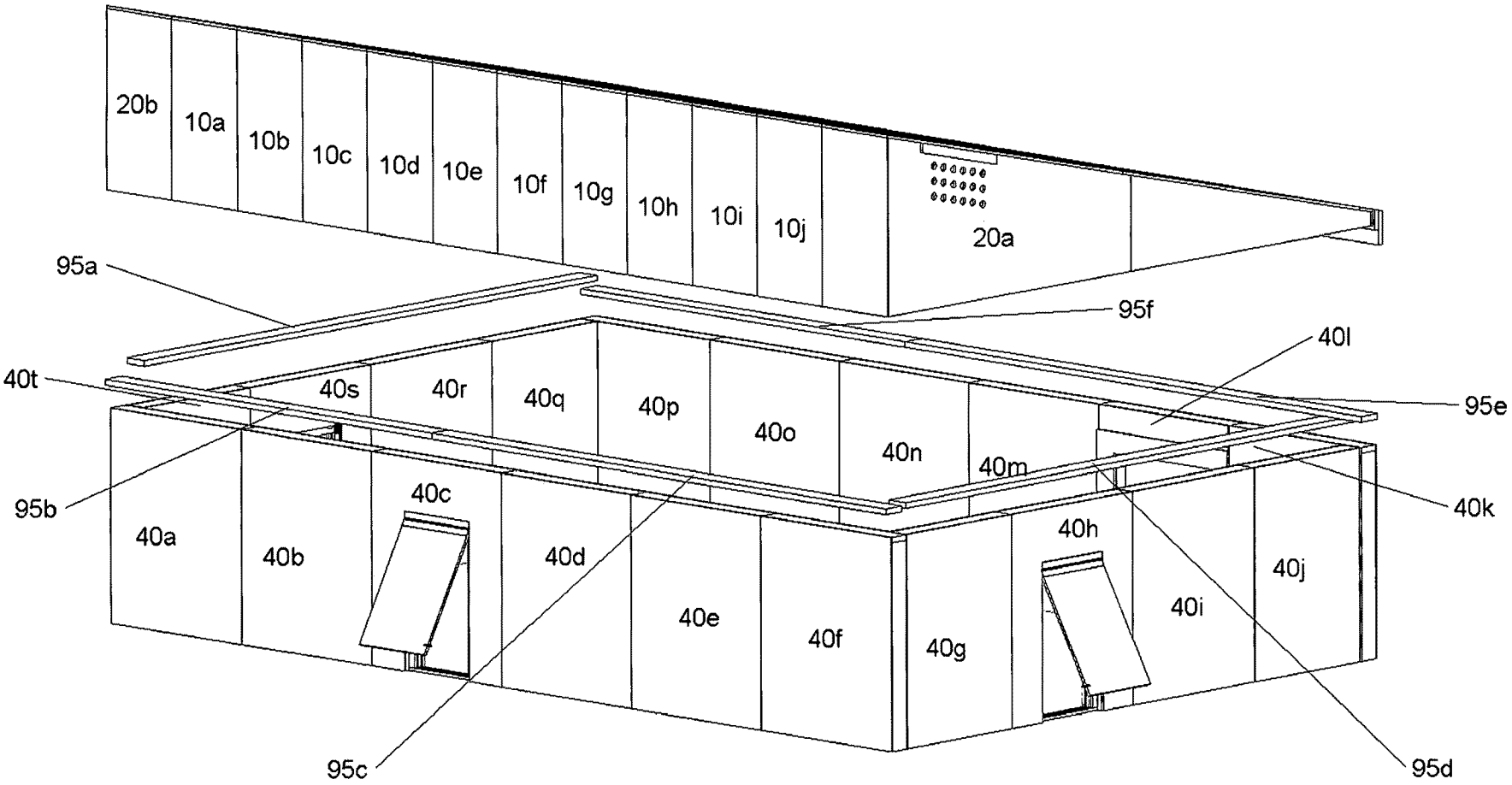
FIG. 1C is an exploded partial view of a CUBE structure.

FIG. 1*c* is a partial exploded view of CUBE structure 100.

Visible in FIG. 1*c* are stackable trussed roof segments 10*a-j,* stackable trussed gabled roof segments 20*a-b,* wall panels 40*a-t,* and binding strips 95*a-f.*

Each wall panel 40, stackable trussed roof segment 10, and stackable trussed gabled roof segment 20 is attached to one of binding strips 95 by screws or other temporary attachment means. Each binding strip 95 attaches to at least two wall panels 40 to prevent the upper edges of wall panels 40 from moving independently of each other, especially in a horizontal direction.

In the exemplary embodiment shown, each binding strip 95 is 2 inches wide, ½ inch thick, and approximately 6 to 16 feet long, to ensure that each binding strip 95 attaches to at least two wall panels 40.

Figure 2:
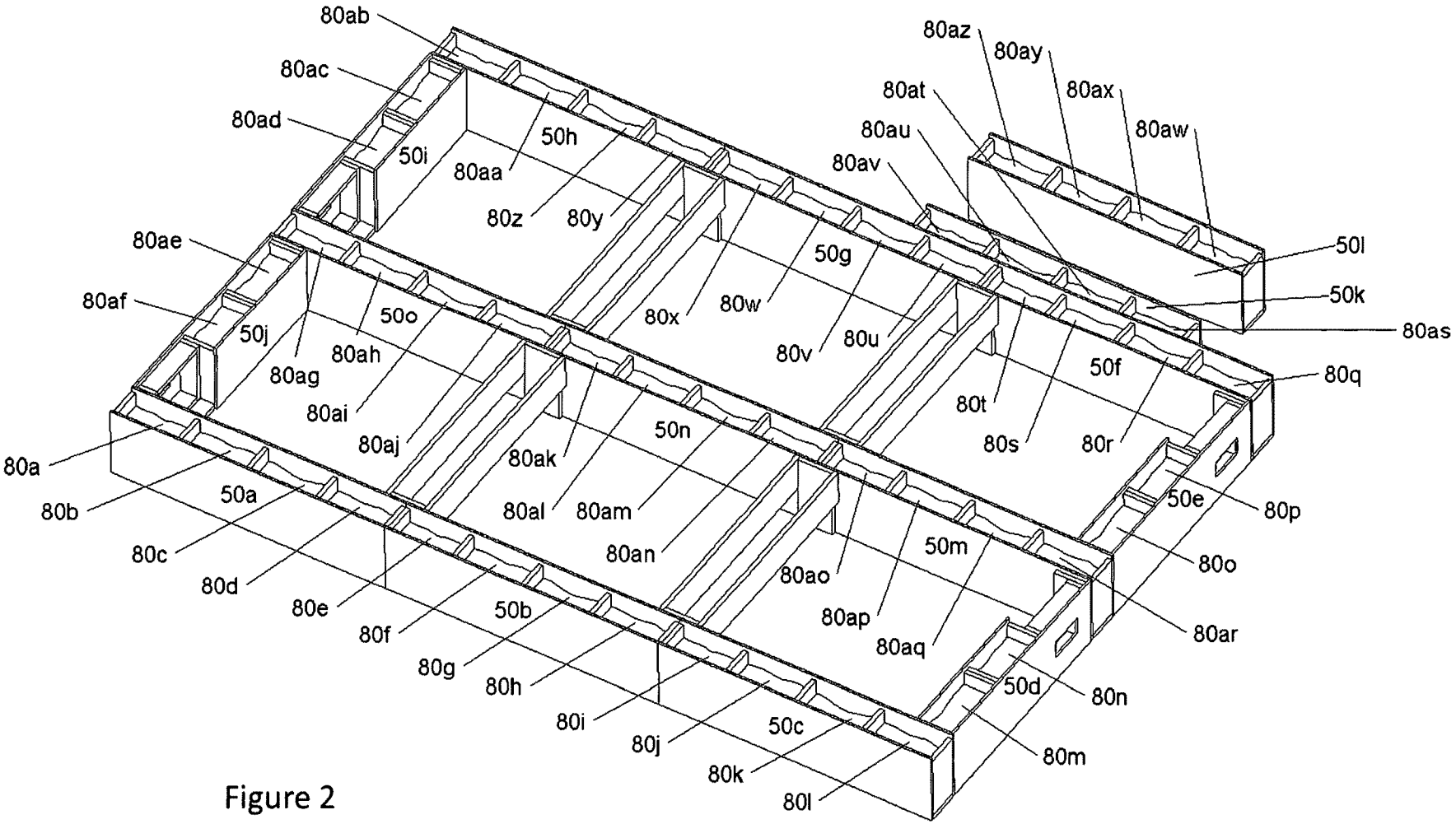
FIG. 2 is an exploded perspective view of the foundation.

FIG. 2 is an exploded perspective view of the foundation.

Visible in FIG. 2 are foundation boxes 50*a-o* and in situ ballast material 80*a-az.*

In the embodiment shown, assembling CUBE structure 100 requires minimal ground leveling of the rectangular perimeter on which foundation boxes 50 stand and placing foundation boxes 50 on the leveled ground. Then, foundation box lids 60 (not shown) temporarily separate from foundation boxes 50 to receive in situ ballast material 80. In situ ballast material 80 holds CUBE structure 100 to the earth and prevents it from tipping over or shifting position. After replacing foundation box lids 60 on foundation boxes 50, floor panels 30 (not shown) lie on top of foundation box lids 60.

Because of foundation boxes 50 and in situ ballast material 80, the CUBE facility requires no connection to or excavation of the ground, which facilitates relocation, does not require digging a trench, and avoids disrupting unexploded ordnance or buried gas or electric lines. Because leveling the ground under foundation boxes 50 only requires shallow digging, the end users in a war zone only need to run a mine detector or mine roller over the ground. Minimizing site preparation requirements also saves time in assembling CUBE structure 100.

In the exemplary embodiment shown, foundation boxes 50 elevate CUBE structure 100 by 3 feet, which avoids flooding in the structure from rain or heavy snow. The minimum floor height above grade for foundation boxes resting at grade level is 3 feet.

In the exemplary embodiment shown, the elevated door on CUBE structure 100 can be reached by an optional entry accessibility component, which may include but is not limited to stairs, a ladder, a step stool, or a ramp. The optional entry accessibility component may be made of dirt, wood, metal, plastic, or another material. The optional entry accessibility component may be collapsible.

In various embodiments, seams between the floor panels do not align with seams between the wall panels, which increases the structural integrity of CUBE structure 100. In various embodiments, CUBE structure 100 includes rubber weather stripping components to seal any seams.

Figure 3A:
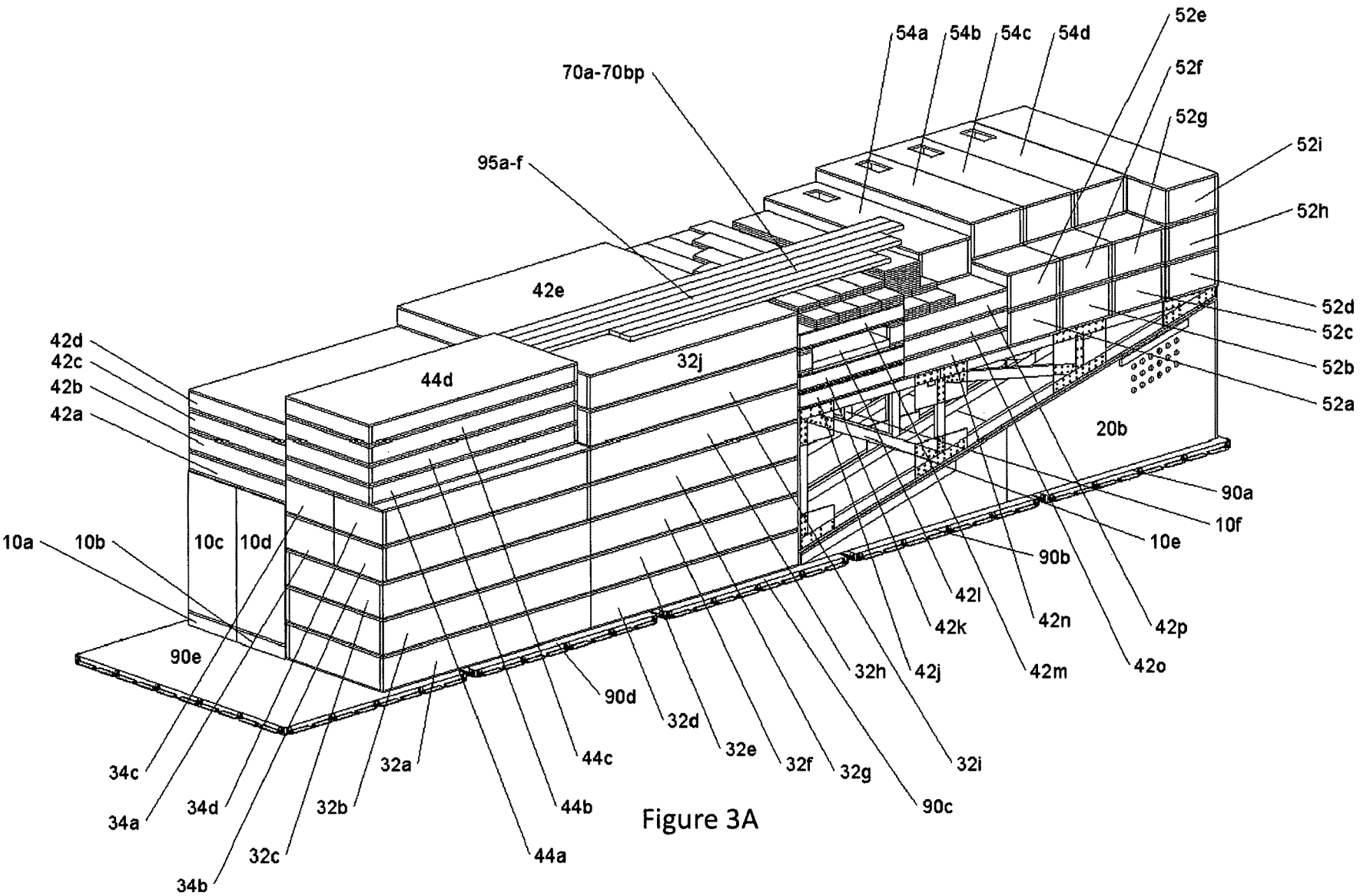
FIGS. 3A and 3B illustrate a CUBE structure disassembled for transport
Figure 3B:
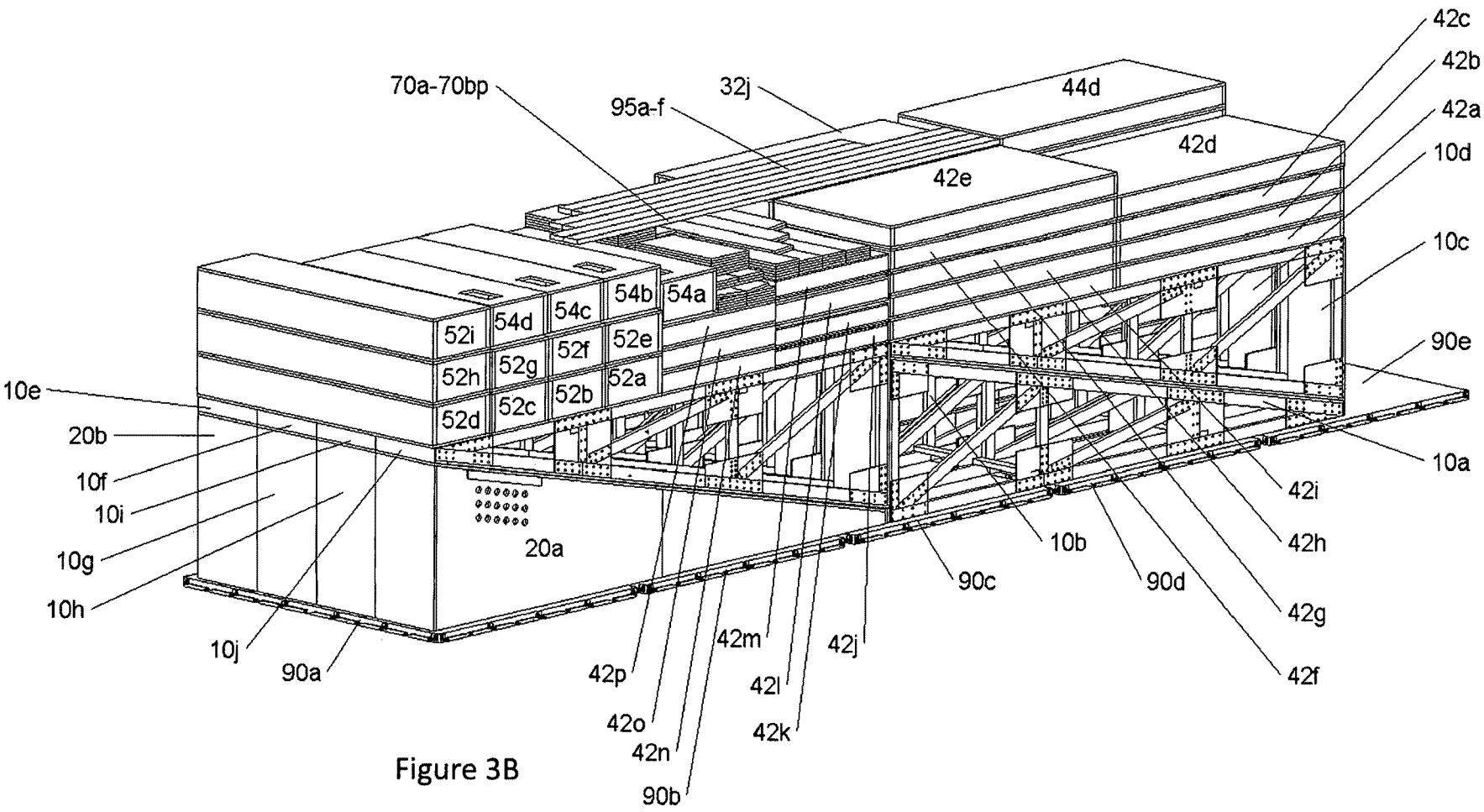

FIGS. 3*a* and 3*b* illustrate CUBE structure 100 disassembled for transport.

In FIG. 3, shipping pallet 90 and the following CUBE components are visible: stackable trussed roof segments 10*a-j,* stackable trussed gabled roof sections 20*a-b,* floor panels 30*a-n,* wall panels 40*a-t,* foundation boxes 50*a-m,* foundation box lids 60*a-i,* batten strips 70*a-x,* and binding strips 95*a-f.*

In the exemplary embodiment shown, one CUBE structure is comprised of 9 long foundation boxes 52*a-i* and 4 short foundation boxes 54*a-d,* 9 long foundation box lids 62*a-i* and 4 short foundation box lids 64*a-d,* 10 wide floor panels 32*a-j* and 4 narrow floor panels 34*a-d,* 16 wide wall panels 42*a-p* and 4 narrow wall panels 44*a-d,* 1 left roof gable 20*a,* 1 right roof gable 20*b,* 10 stackable trussed roof panel segments 10*a-j,* 16 narrow and 8 wide batten strips 70*a-x,* and 6 binding strips 95*a-f.*

Shipping pallet 90 is not necessary for shipping CUBE components, but in the exemplary embodiment shown, all CUBE components fit on shipping pallet 90.

In the exemplary embodiment shown, the fabricated components of this CUBE facility fit within the shipping requirements of the pallets used on military aircraft and medium sized trucks. The fabricated components of this facility fit upon a standard military cargo truck such that one complete disassembled structure can be transported by one truck.

In the exemplary embodiment shown, shipping pallet 90 is a 463L HCU-6/E Pallet with dimensions of 88 inches by 108 inches. This pallet can fit within a standard shipping container, on cargo trucks, flat bed trailers, inside cargo trailers and inside some civilian aircraft. The list of US Military aircraft that carries this pallet includes but is not limited to: C-130, C-5, C-17, KC-135, C-27, C-9, CH-47, and KC-10. Although shipping CUBE does not require these specific shipping pallets, the military requires the use of these pallets for transporting goods within US Military aircraft and compatible foreign aircraft.

In the exemplary embodiment shown, CUBE structure 100 utilizes 21 separate lumber and fastener components. Other embodiments may use more or fewer lumber and fastener components.

In the exemplary embodiment shown, if any individual component fails, the uniform size of components and the use of batten strips instead of interior attachment points makes it easy to replace individual component panels.

In the exemplary embodiment shown, each individual component is less than 200 pounds to eliminate the requirement of heavy equipment. Individual components are movable by two to four people.

In the exemplary embodiment shown, the dimensions of these components maximize the use of standard size plywood sheets (4×8 feet or 1.2×2.4 meters) and minimize the amount of cutting, thus minimizing labor costs. Fabrication of individual components in a production or factory site does not require use of proprietary methods or machinery.

In various embodiments, each manufactured roof, wall, and floor panel is comprised of multiple layers that include an outer plywood layer attached to a lumber framework (e.g. studs), insulation, and a second layer of plywood. The plywood may be attached by nails or screws to the framework. The insulation may be fiberglass or rock wool.

In various embodiments, panels do not include insulation.

In the exemplary embodiment shown, Douglas fir wood may serve as the main material for each component. Wood is available globally and expected to last 5 years after assembly and exposure to weather, which may be increased to approximately 50 years with a weather proofing coating or protective layer.

In one exemplary embodiment, panels may include a weather proofing layer such as paint, water repellent, sealant, or siding on the exterior surface.

In various embodiments, components may be constructed from lumber, bamboo coated with water repellent, fiberglass, or metal. Fiberglass is easy to sterilize, which allows the structure to be used as a hospital or clinic, and fiberglass is also resistant to termites.

In the exemplary embodiment shown, assembling CUBE structure 100 requires a ladder. In an alternative embodiment, CUBE structure 100 includes a component that serves as a ladder and eliminates any requirement for a ladder.

Figure 4A:
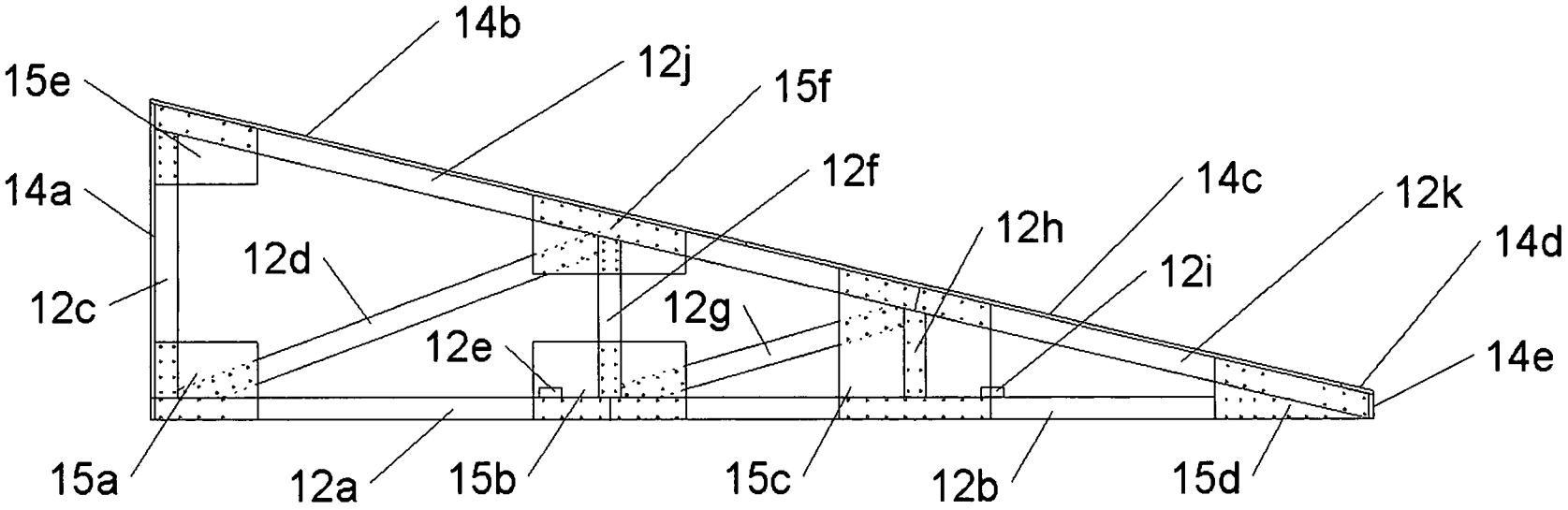
FIGS. 4A and 4B illustrate an exemplary embodiment of stackable trussed roof segments, both assembled for use and exploded.
Figure 4B:
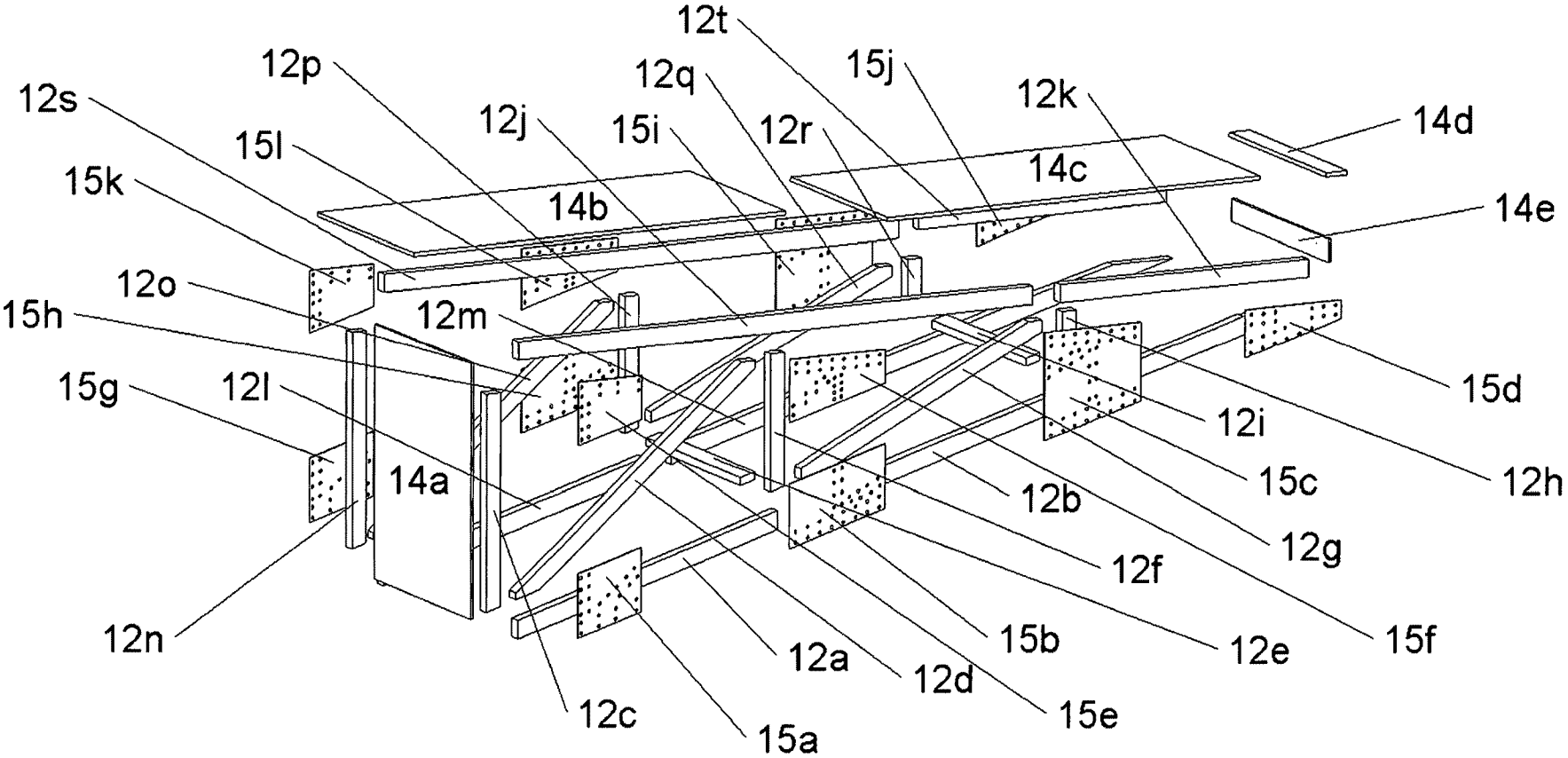

FIGS. 4*a* and 4*b* illustrate an exemplary embodiment of stackable trussed roof segments 10, both assembled for use and exploded.

Visible in FIGS. 4*a* and 4*b* are stackable trussed roof segments 10, truss frame segments 12*a-k,* rectangular roof plates 14*a-d,* and frame attachment points 15*a-f.*

In the exemplary embodiment shown, stackable trussed roof segments 10 are comprised of parallel sets of truss frame segments 12, mounted to each other and to outer edges of rectangular roof plates 14 at frame attachment points 15.

Rectangular roof plate 14*a* is oriented vertically and the top edge makes contact with an edge of rectangular roof plate 14*b*. In the exemplary embodiment shown, rectangular roof plate 14*b* does not span the entire length of stackable trussed roof segment 10 and the opposite edge of rectangular roof plate 14*b* makes contact with an edge of rectangular roof plate 14*c*. The opposite edge of rectangular roof plate 14*c* makes contact with rectangular roof plate 14*d*.

In the exemplary embodiment shown, rectangular roof plate 14*a* is 2 feet wide and 4 feet tall and rectangular roof plate 14*b* is 2 feet wide and 8 feet long. In the exemplary embodiment shown, rectangular roof plate 14*c* is 2 feet wide and 8 feet long and rectangular roof plate 14*d* is 2 feet wide and 6 and ⅛ inches long.

In various embodiments, stackable trussed roof segments 10 and rectangular roof plates 14 are 2-4 feet wide and as long as the external width of CUBE structure 100. The optimum width of the stackable trussed roof segments is 2 feet for assembly without machinery assistance, the maximum width of the stackable trussed roof segments is 4 feet for assembly with machinery assistance.

In various embodiments, truss frame segments 12 are 2×4 or 2×6 boards, cut to the appropriate length.

In various embodiments, stackable trussed roof segments 10 are shipped fully assembled to reduce the number of loose pieces that can be misplaced and the assembly time for the end user, and to avoid requiring the end user to accurately place and install trusses.

Figure 5C:
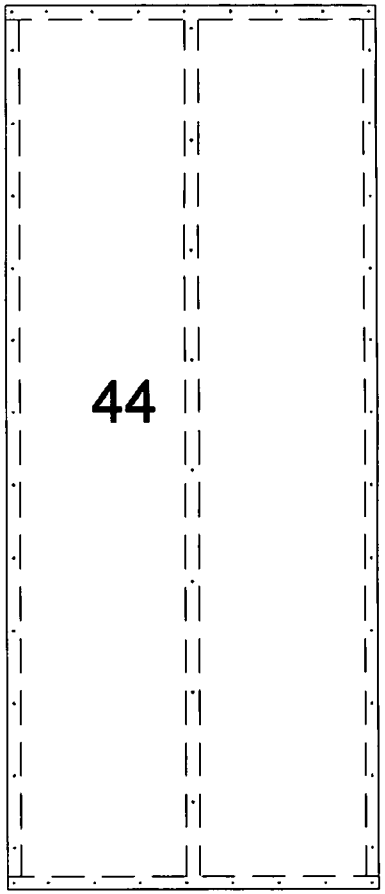
FIGS. 5A, 5B and 5C illustrate an exemplary wall panel.
Figure 5B:
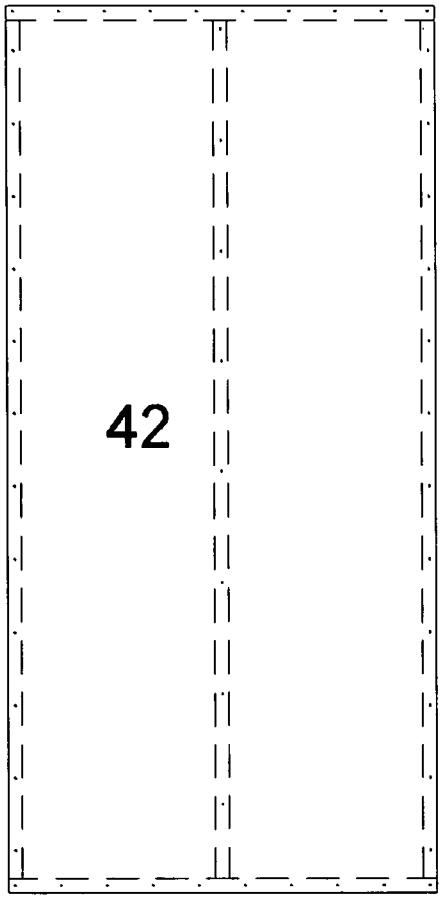
Figure 5A:
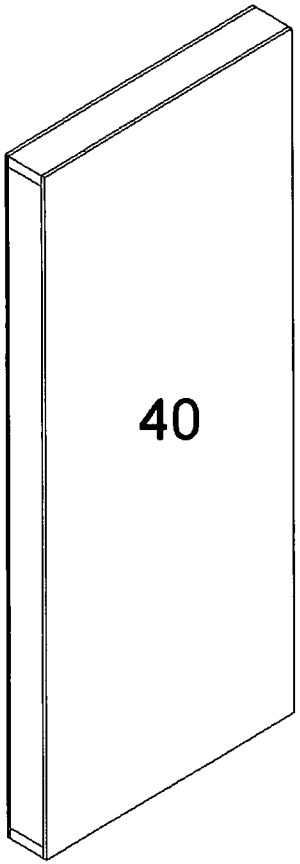

FIG. 5 illustrates exemplary wall panel 40.

Visible in FIG. 5 are wide wall panels 42 and narrow wall panels 44. In the exemplary embodiment shown, the width of wide wall panels is 4 feet and the width of narrow wall panels is 3 feet 5 and one half inches. Each wall panel is 8 feet tall.

In various embodiments, each kit includes 16 wide wall panels 42 and 4 narrow wall panels 44. In various embodiments, wall panels may include a window or a door that does not affect the structural integrity or the installation procedure for the wall panel.

Figure 6C:
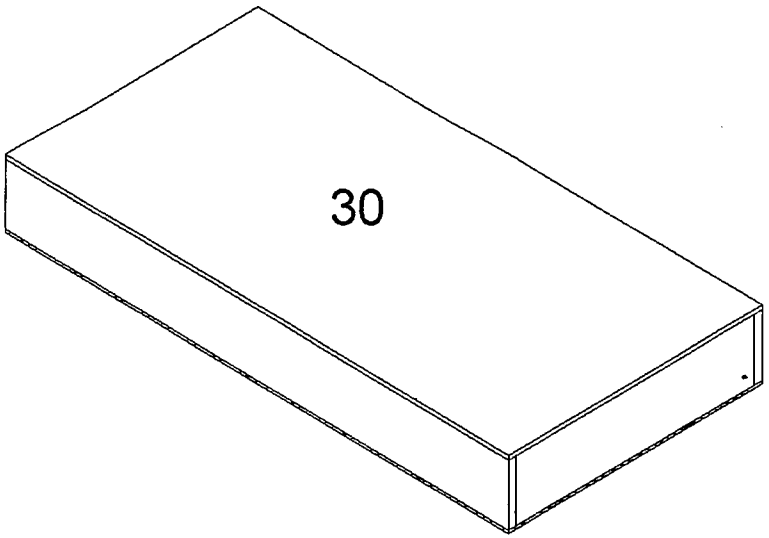
FIGS. 6A, 6B and 6C illustrate an exemplary floor panel.
Figure 6B:
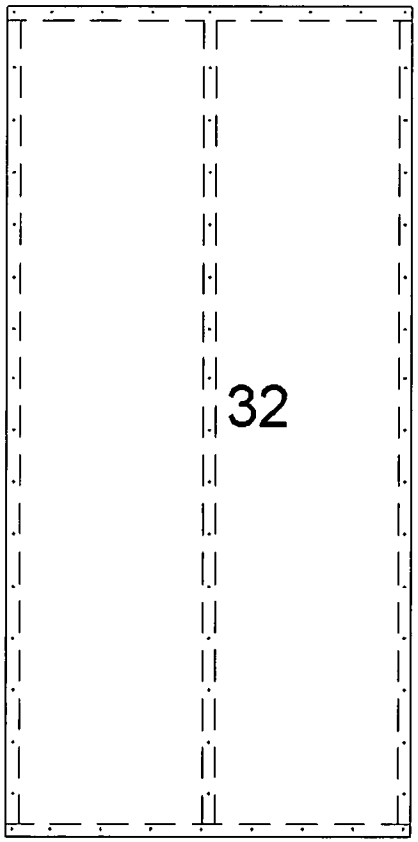
Figure 6A:
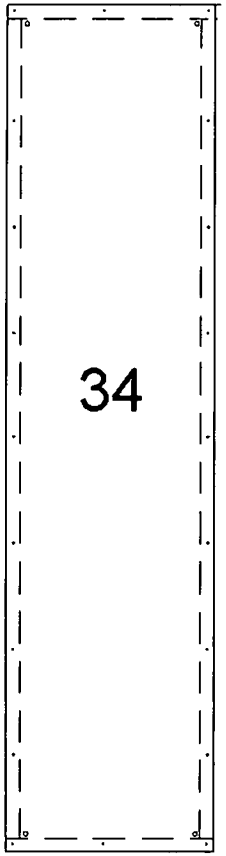

FIG. 6 illustrates exemplary floor panel 30.

Visible in FIG. 6 are wide floor panels 32 and narrow floor panels 34.

In various embodiments, each kit includes 10 wide floor panels 32 that are 4 feet wide and 4 narrow floor panels 34 that are 2 feet wide. The width of wide floor panels is 4 feet. The width of narrow floor panels is 2 feet. Each floor panel is 8 feet long.

Figure 7B:
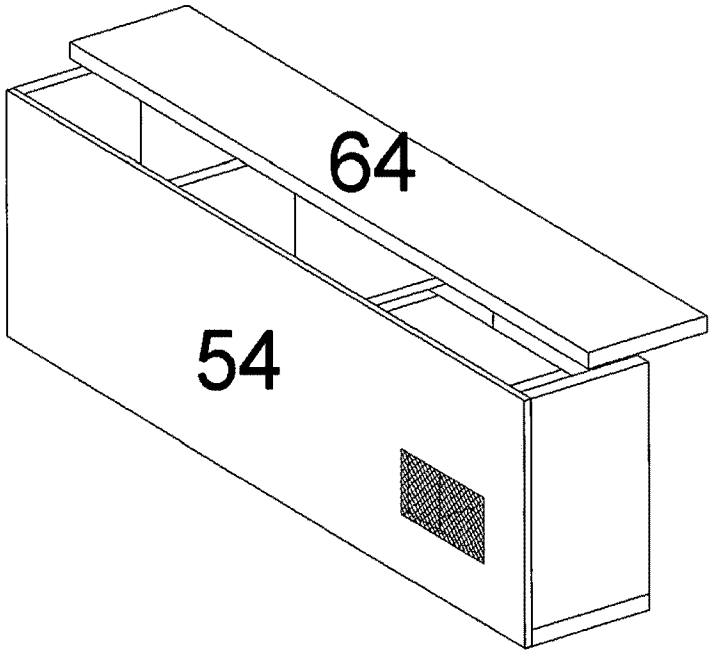
FIGS. 7A, and TB illustrate an exemplary foundation box
Figure 7A:
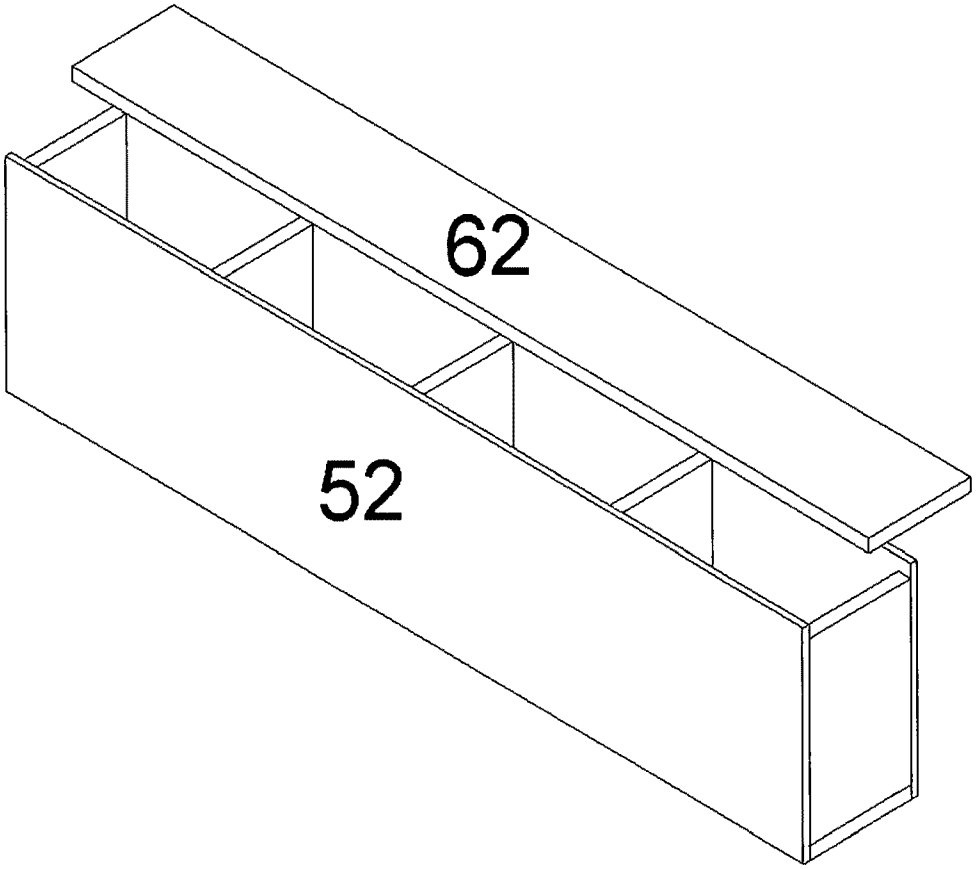

FIG. 7 illustrates exemplary foundation box 50.

Visible in FIG. 7 are long foundation box 52, short foundation box 54, long foundation box lid 62, and short foundation box lid 64.

In various embodiments, each kit includes 9 long foundation boxes 52, 9 long foundation box lids 62, 4 short foundation boxes 54, and 4 short foundation box lids 64. In the exemplary embodiment shown, each foundation box 50 and each foundation box lid 60 is 1 foot three quarters inch wide. The length of each long foundation box 52 and each long foundation box lid 62 is 8 feet. The length of each short foundation box 54 and each short foundation box lid 64 is 6 feet 4 and seven eighths inches.

In one exemplary embodiment, foundation box 50 ships as a fully constructed box with removable foundation box lid 60 for adding in situ ballast material 80.

In various embodiments, foundation box 50 may include a vent.

Figure 8A:
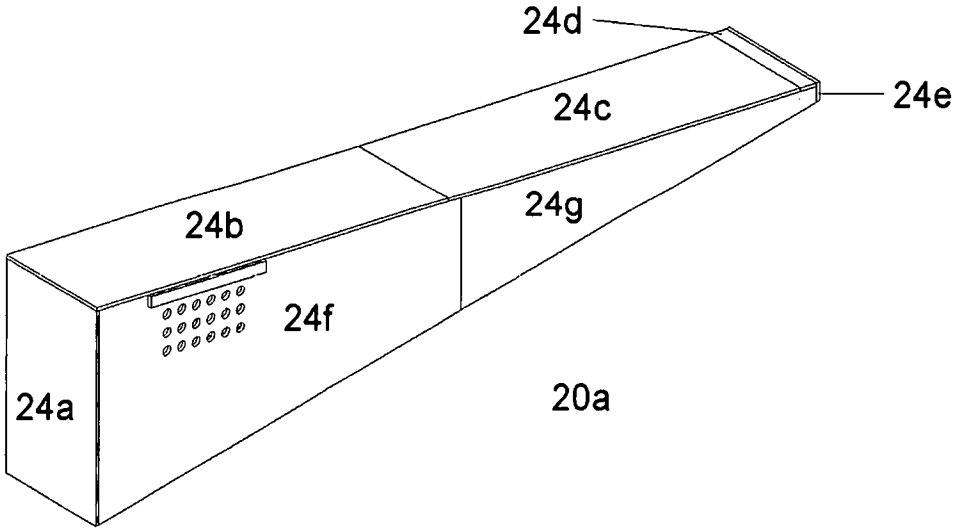
FIGS. 8A, 8B and 8C illustrate an exemplary roof gable.
Figure 8B:
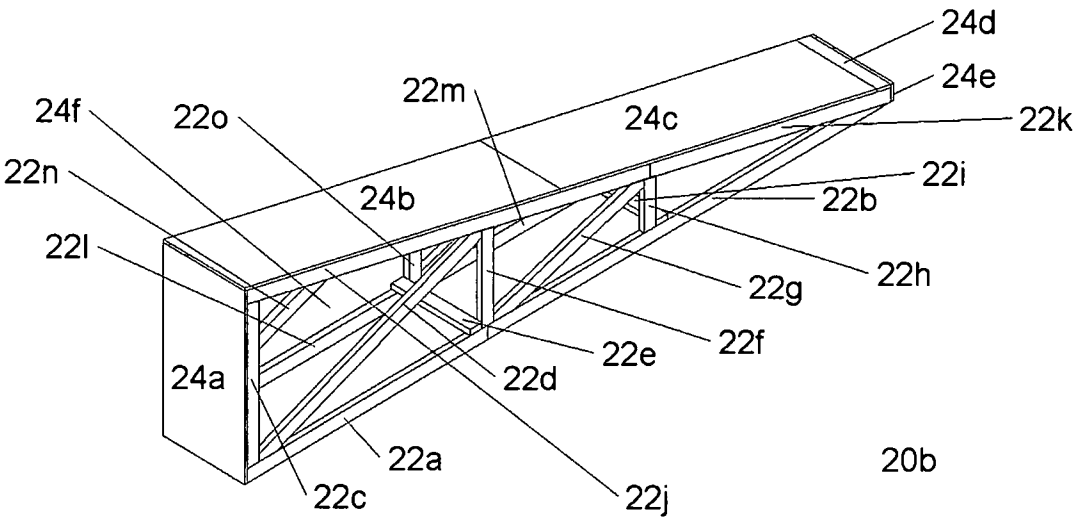
Figure 8C:
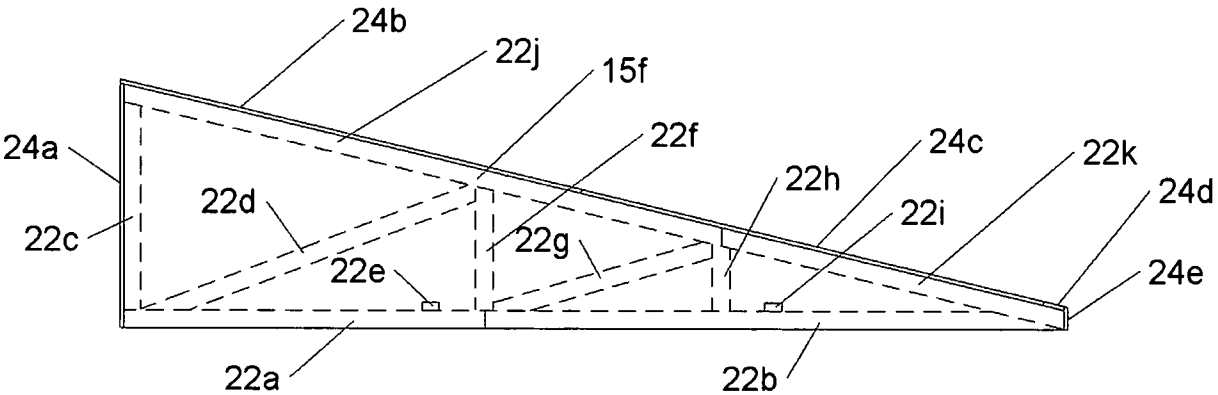

FIG. 8 illustrates exemplary stackable trussed gabled roof section 20.

Visible in FIG. 8 are stackable trussed gabled roof sections 20*a-b,* truss frame segments 12, and triangular panels 24.

In one exemplary embodiment, each kit includes two stackable trussed gabled roof sections 20*a-b* which are comprised of triangular panels 24 attached to truss frame segments 12 of two bookend stackable trussed roof sections 10 to close the roof structure. Triangular panels 24 are 4 feet tall on the vertical side, 16 feet wide on the horizontal side, and the third side is 16 feet, 6 and ⅛ inches long.

In various embodiments, stackable trussed gabled roof sections 20 may include a vent. In the exemplary embodiment shown, the minimum vent area is 28 square inches.

What is claimed is:

1. A rapidly assembled and disassembled housing apparatus comprised of:

a plurality of foundation boxes;

a plurality of foundation box lids:

a quantity of in situ ballast material placed within one or more of said foundation boxes;

a plurality of floor panels:

a plurality of wall panels;

a plurality of binding strips;

a plurality of stackable trussed root segments:

a plurality of roof gables: and a plurality of load transferring batten strips, wherein said batten strips (i) transfer force from said stackable trussed roof segments and said wall panels to said floor panels and said foundation boxes, (ii) cover vertical lengths from a top of said stackable trussed roof segments to a bottom of said foundation boxes and (iii) cover a horizontal width of each wall of said housing apparatus at a seam where said foundation boxes meet said floor panels and said floor panels meet said wall panels.

2. The apparatus of claim 1, wherein said foundation boxes further includes short foundation boxes and long foundation boxes.

3. The apparatus of claim 1, wherein said foundation box lids further includes short foundation box lids and long foundation box lids.

4. The apparatus of claim 1, wherein said floor panels further includes wide floor panels and narrow floor panels.

5. The apparatus of claim 1, wherein said plurality of wall panels further includes wide wall panels and narrow wall panels.

6. The apparatus of claim 1, wherein at least one of said wall panels further includes a door.

7. The apparatus of claim 1, wherein at least one of said wall panels further includes a window.

8. The apparatus of claim 1, which further includes a protective layer.

9. The apparatus of claim 8, wherein said protective layer is selected from a group consisting of: siding, paint, water repellent, and sealant.

10. The apparatus of claim 1, which further includes insulation.

11. The apparatus of claim 10, wherein said insulation is selected from a group consisting of: fiberglass insulation and rock wool insulation.

12. The apparatus of claim 1, wherein said floor panels further include insulation.

13. The apparatus of claim 1, wherein said wall panels further include insulation.

14. The apparatus of claim 1, which further includes at least one accessibility component selected from a group consisting of: stairs, a ramp, a ladder, and a step stool.

15. The apparatus of claim 1, wherein said stackable trussed roof segments further include a plurality of truss frame segments, at least one rectangular roof plate, and at least one frame attachment point.

16. The apparatus of claim 1, wherein said roof gables further includes at least one truss frame segment and at least one triangular panel.

17. The apparatus of claim 1, wherein at least one of said roof gables further includes a vent.

18. The apparatus apparatus of claim 1, wherein at least one of said foundation boxes includes a vent.

19. The apparatus of claim 1, wherein components are not attached to each other except by batten, strips and there are no interior attachment components.

20. The apparatus of claim 1, wherein said apparatus requires no connection to the ground.

* * * * *